United States Patent [19]

Schmidt

[11] 4,389,077

[45] Jun. 21, 1983

[54] COMPACT POSITION LOCK PARTS BIN

[76] Inventor: LaVern Schmidt, P.O. Box 234, Montezuma, Kans. 60867

[21] Appl. No.: 253,002

[22] Filed: Apr. 10, 1981

Related U.S. Application Data

[63] Continuation-in-part of Ser. No. 72,035, Sep. 4, 1979, Pat. No. 4,266,835.

[51] Int. Cl.[3] ..... A47B 53/00; A47B 95/02

[52] U.S. Cl. ..... 312/244; 312/270; 312/320; 312/DIG. 33

[58] Field of Search ..... 312/244, 243, 242, DIG. 33, 312/39, 209, 320, 269, 270

[56] References Cited

U.S. PATENT DOCUMENTS

| | | | |
|---|---|---|---|
| 603,467 | 5/1898 | Hoff | 312/209 |
| 923,939 | 6/1909 | Braun | 312/320 |
| 1,510,240 | 9/1924 | Myers | 312/DIG. 33 |
| 2,046,244 | 6/1936 | Carner | 312/DIG. 33 |
| 2,386,573 | 10/1945 | Randall | 312/DIG. 33 |
| 2,564,949 | 8/1951 | Bell | 312/244 |
| 2,582,812 | 1/1952 | Wise | 312/242 |
| 2,641,520 | 6/1953 | Moore | 312/DIG. 33 |
| 3,012,658 | 12/1961 | Flora | 312/258 |
| 3,025,829 | 3/1962 | Smith | 312/39 |
| 3,047,350 | 7/1962 | Eckstein et al. | 312/244 |
| 3,408,126 | 10/1968 | Mortensen | 312/244 |
| 3,967,869 | 7/1976 | Jackson | 312/DIG. 33 |
| 4,006,821 | 2/1977 | Sautter | 312/DIG. 33 |

*Primary Examiner*—Victor N. Sakran
*Attorney, Agent, or Firm*—Richard L. Miller

[57] ABSTRACT

A storage lock box is provided for parts such as washers, bolts, nuts and the like. The lock box has an inclined shelf within that is provided with a plurality of holes for storing bolts, while the shelf is closed off by a pivotable cover which has a plurality of pegs for storing washers and nuts, and the like. The pegs of the cover abut against the cover lid of the lock box when the cover lid is closed so that the cover is prevented from rotating, thereby preventing the parts on the pegs of the cover and in the holes of the shelf from falling out of their storage locations during transport of the lock box.

6 Claims, 3 Drawing Figures

COMPACT POSITION LOCK PARTS BIN

REFERENCE TO RELATED APPLICATION

The present application is a continuation-in-part of copending Application Ser. No. 072,035 now U.S. Pat. No. 4,266,835 now, filed Sept. 4, 1979.

BACKGROUND OF THE INVENTION

In co-pending Application Ser. No. 072,035, a lock storage box for tools is described in which a case having a plurality of storage compartments is provided in which tools are stored. In that lock box, it is difficult to store parts such as washers, nuts, bolts, and the like so they will not be dislocated during movement of the box, since the compartments are of such size as to accommodate tools of fairly considerable size, as compared with much smaller nuts and bolts.

SUMMARY OF THE INVENTION

It is, therefore, the primary object of the present invention to provide a compact storage lock bin for small parts such as nuts, bolts, washers, and the like so that these parts are held in their storage places even if the lock box is accidentally dropped or overturned.

To this end, the lock bin of the present invention is provided with an inclined shelf having a plurality of holes formed therethrough, in series, such that each series has holes having a diameter which is larger or smaller than another series, so that a variety of sizes of bolts and the like may be stored in the holes. A cover is provided, which cover is pivotted to an upper portion of the case, so that when the cover is pivotted downwardly, it closes off the shelf so that the bolts stored therein are prevented from escaping, if the lock box is dropped or overturned. The cover also is provided with a plurality of pegs extending outwardly, in a direction away from the rear wall of the case on which may be stored washers, nuts, and the like. The pegs are provided along the length and width of the cover, and extend outwardly from the front surface thereof such that when the cover lid of the case is closed, at least some of the pegs abut against the inner surface of the cover lid, thereby preventing the cover from rotating in either the clockwise or counterclockwise directions. Thus, the parts stored on the pegs are held thereon, and the parts stored in the holes of the shelf are held fast therein due to the bottom surface of the cover abutting against the parts themselves.

The case is also provided with additional compartments of varying sizes to accommodate other elements needed during a given job or function.

BRIEF DESCRIPTION OF THE DRAWING FIGURES

The invention will be more readily understood with reference to the accompanying drawing, wherein FIG. 1 is a perspective view of the compact position parts box of the present invention;

DETAILED DESCRIPTION OF THE PREFERRED EMBODIMENT

Figure 1:
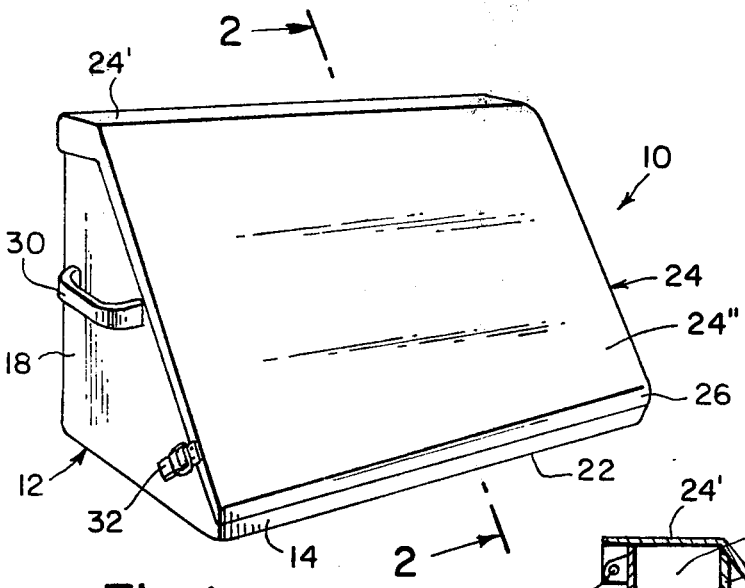
Figure 2:
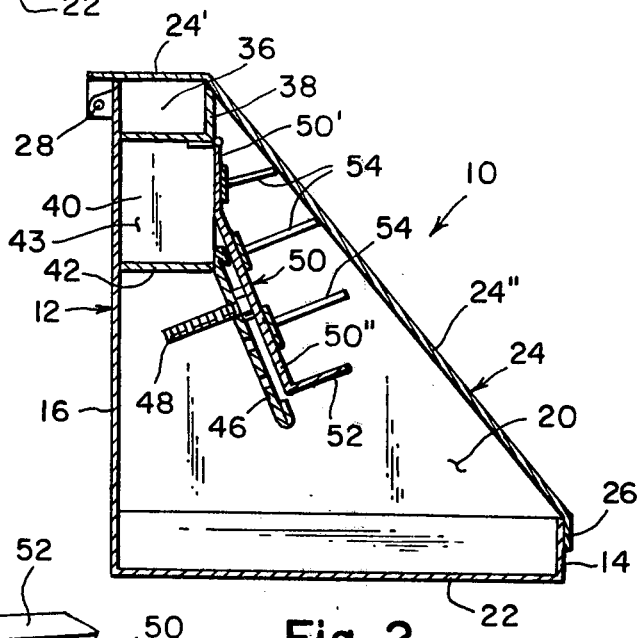
FIG. 2 is a cross-sectional view taken along line 2—2 of FIG. 1.

Referring now to the drawing, the compact position parts bin of the present invention is generally indicated by reference numeral 10. The parts lock bin 10 has a main case 12 which is made of a low front wall 14, a high rear wall 16, a pair of truncated triangular side walls 18, 20, and a bottom wall 22. The case 12 is closed off by a hinged cover lid 24 which has a first portion 24' pivotted to the top of the rear wall by hinges 28. The first portion 24' extends perpendicularly to the rear wall 16 when the cover lid is in its closed, locked position, as shown in FIG. 2. A second portion 24" of the cover lid 24 extends at an acute angle relative to the first portion 24' and downwardly therefrom, and ends in a lip 26 which overlaps a portion of the low front wall 14, and on which a suitable safety lock (not shown) may be attached if so desired. A pair of handles 30, one on each of the side walls, are provided for easy carrying of the case, and a pair of fastening buckles 32 are also provided on the side walls which cooperate with corresponding elements on the cover lid 24 for securing the cover lid in its closed position, as shown in FIG. 1.

Within the case 12, there are formed a plurality of compartments for storing parts, such as nuts, bolts, washers, cotton pins, and the like as will be evident from the following description. A first compartment 36 is provided at the top of the rear wall 16 by right angle bracket 38 having a lower portion parallel to the bottom wall 22, and a portion at right angles to the lower portion. The right angle portion of the first compartment means extends upwardly from the lower portion to a level slightly lower than the top of the rear wall 16 so that the portion 24" of the inclined cover lid may pass thereby. The first parts compartment 36 is closed off when the cover lid 24 is in its closed position of FIG. 2 by the portion 24', as shown in FIG. 2.

Figure 3:
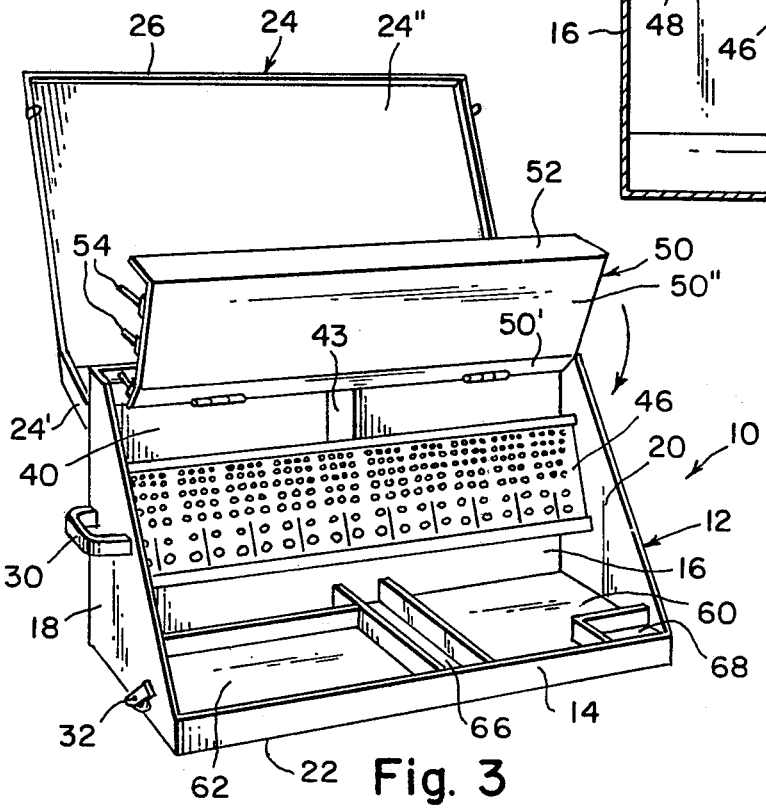
FIG. 3 is a perspective view similar to FIG. 1 with the lock box shown with the cover lid in the open position.

Directly below the compartment 36, a second parts compartment 40 is provided, which compartment is formed by the rear wall 16, and bracket 42 extending at right angles to the rear wall. Bracket 42 projects outwardly from the rear wall a distance approximately equal to the projection of the lower portion of the bracket 38 from the rear wall. The compartment 40 may be subdivided by a partition 43 so that two similar and equal-sized sub-compartments are formed, as shown in FIG. 3.

The first storage compartment 36 may store tapes, lock washers, and the like, while the compartment 40 may store similar items and those of greater bulk.

Fixedly connected to the front of the bracket 42 is a shelf 46 having a plurality of holes formed therein. The holes formed in the shelf 46 are preferably of a series of holes of different diameters so that varying sized bolts, such as 48 shown in FIG. 2, may be passed therethrough and stored for subsequent use. In FIG, 3, 7 such series are shown with each series having a greater diameter hole than the hole in the preceeding series above it. As can be seen in FIG. 2, the shelf 46 is inclined relative to the rear wall 16, and extends at an acute angle from the bracket 42.

Pivotally connected to the right angle bracket 38, is a cover 50, which has a first portion 50' hinged to the bracket, and a second inclined portion 50". The portion 50" has a perpendicular extension 52 at its end thereof projecting in a direction away from the rear wall. A plurality of pegs 54 project outwardly from the front surface of the cover 50. The pegs extend along the face of the cover, both along its length and along is width. The pegs serve to store thereon nuts, flat washers, lock washers, and the like, and also serve to prevent the cover 50 from pivotting when the cover lid 24 is in its closed locked position shown in FIG. 2. Since at least some of the pegs 54 abut against the cover lid 24 when the lid is closed, rotation of the cover 50 is prevented in either the clockwise or counter-clockwise directions.

The bottom of the case 12 is also provided with compartments for storing articles, and typically has 5 such compartments, as shown in FIG. 3. Compartment 60, being of large size, may store therein tapes and related items, while compartment 62 may store therein a kit, or the like contained in its own package. Compartment 66, of elongated and rectangular shape, may store any item of similar shape, while compartment 68, being of small size, may store a wire spool holder for ready availability.

The box itself is made of steel, and typically has a weight of approximately 66 pounds.

It is thus seen that all nuts, washers, bolts, and the like which are stored on the shelf 46 and the cover 50 are prevented from falling out of their respective storage locations when the cover lid 24 is locked into its closed position. The parts in the holes of the shelf 46 are secured in place by the cover 50 overlapping resting on them, and the parts in the pegs 54 are secured in storage by the cover lid 24 itself when in its closed position, so that if the box is accidentally dropped or overturned, the parts therein are not displaced and mixed up. Thus, readily available access to a desired size and part is assured. Further, the parts in the bottom compartments 60–68 are prevented from any great displacement since the shelf 46 and cover 50, as well as the cover lid 24, serve as a protective covering limiting the possible displacement thereof.

While a specific embodiment of the invention has been shown and described, it is to be understood that numerous changes and modifications may be made without departing from the scope and spirit of the invention as set out in the appended claims.

What is claimed is:

1. A compact position lock parts bin, comprising, in combination, a case within which a plurality of parts holding compartments are formed; a cover lid connected to said case; first hinge means pivotally connecting said cover lid to said case; said case having a pair of side walls, said first hinges connecting said cover lid to said case at first ends of said pair of side walls, a low front wall connecting said side walls, a rear wall also connecting said side walls and spaced from said low front wall, said cover lid when in the closed position resting upon an edge of each of said pair of side walls; said case further comprising an inclined shelf means fixedly secured in said case and having a plurality of holes formed therethrough for storing bolts and the like; and a cover means pivotally mounted to said case for movement between a first open position and a second closed position in which said second cover overlays said inclined shelf means to prevent the parts in said plurality of holes from falling out, said cover means having second hinge means pivotally connected to said case above said top edge surface of said inclined shelf means, and means on said cover means for preventing said cover means form moving to its first open position form its second closed position when said cover lid is in its closed, locked position, wherein said means for preventing on said cover means comprising a plurality of outwardly extending pegs, each said peg extending from the surface of said cover means facing said cover lid when both said covers are in their closed positions, at least some of said plurality of pegs abutting against said cover lid when both said covers are in their closed positions, wherein said case comprises a first parts compartment means at the top thereof and extending from the top of said rear wall, said second hinge means pivotally connected to said case being connected to said first compartment means, wherein said case further comprises a second parts compartment means directly below said first compartment means, said inclined shelf means being connected at its top edge surface thereof to the bottom of said second compartment means, said cover means closing off both said second compartment means and said shelf means when in said closed position; said second compartment means having an open front face by which said cover means closes off said second compartment means when in said closed position.

2. The compact position locks parts bin according to claim 1, wherein said case further comprises a third compartment means located at the bottom thereof between said rear wall and said low front wall.

3. The compact position lock parts bin according to claim 2, wherein said pair of side walls are each of triangular shape; and said cover lid has a first portion thereof pivotally connected to said rear wall of said case, and a second portion extending at an angle from said first portion, said first portion of said cover lid closing off said first compartment means when said cover lid is in its closed position, said first compartment means having an opening facing upwardly by which said first portion by engaging flush with said first compartment means closes off said opening.

4. The compact position lock parts bin according to claim 3, wherein said shelf means extends at an angle from said first compartment means and downwardly therefrom, said shelf means forming an acute angle with a vertical plane, which angle is less than the angle by which said second portion of said cover lid extends from said first portion of said cover lid.

5. The compact position lock parts bin according to claim 4, wherein said cover means comprises a first portion which is pivotted to said first compartment means, and a second portion extending at an acute angle from said first portion, said second portion of said cover means extending at an angle from said first portion thereof approximately equal to said acute angle of said shelf means.

6. The compact position lock parts bin according to claim 5, wherein said first portion of said cover means closes off a portion of said second compartment means, and part of said second portion of said cover means closes off the rest of said second compartment means.

* * * * *